US008371872B2

(12) United States Patent
Zhou

(10) Patent No.: US 8,371,872 B2
(45) Date of Patent: Feb. 12, 2013

(54) ROTATING PLUG

(75) Inventor: Jianlin Zhou, Dongguan (CN)

(73) Assignee: Mig Electronic Industrial Co., Ltd., Dongguan (CN)

( * ) Notice: Subject to any disclaimer, the term of this patent is extended or adjusted under 35 U.S.C. 154(b) by 35 days.

(21) Appl. No.: 13/212,020

(22) Filed: Aug. 17, 2011

(65) Prior Publication Data

US 2013/0005176 A1 Jan. 3, 2013

(30) Foreign Application Priority Data

Jun. 30, 2011 (CN) ..... 2011 2 0229656 U

(51) Int. Cl.
*H01R 13/56* (2006.01)

(52) U.S. Cl. ..... 439/446

(58) Field of Classification Search ..... 439/446, 439/31, 518, 11

See application file for complete search history.

(56) References Cited

U.S. PATENT DOCUMENTS

| | | | | |
|---|---|---|---|---|
| 1,981,854 | A * | 11/1934 | Comiskey | 439/6 |
| 2,511,772 | A * | 6/1950 | Finizie | 439/11 |
| 4,959,021 | A * | 9/1990 | Byrne | 439/310 |
| 5,681,171 | A * | 10/1997 | Park | 439/31 |
| 5,692,921 | A * | 12/1997 | Jennings | 439/346 |
| 6,663,396 | B1 * | 12/2003 | Wang | 439/31 |
| 6,695,620 | B1 * | 2/2004 | Huang | 439/11 |
| 6,780,034 | B2 * | 8/2004 | Shiroshita et al. | 439/174 |
| 6,991,467 | B1 * | 1/2006 | Cheng et al. | 439/10 |
| 7,168,969 | B1 * | 1/2007 | Wang | 439/173 |
| 7,234,963 | B1 * | 6/2007 | Huang | 439/446 |
| 7,399,209 | B2 * | 7/2008 | Kodaira | 439/640 |
| 7,416,413 | B2 * | 8/2008 | Liao | 439/11 |
| 7,438,574 | B2 * | 10/2008 | Neumann | 439/172 |
| 7,507,108 | B2 * | 3/2009 | Tsuji | 439/446 |
| 7,549,877 | B1 * | 6/2009 | Vista et al. | 439/172 |
| 7,614,903 | B1 * | 11/2009 | Huang | 439/446 |
| 7,811,136 | B1 * | 10/2010 | Hsieh et al. | 439/640 |
| 7,815,471 | B2 * | 10/2010 | Wu | 439/640 |
| 7,828,555 | B1 * | 11/2010 | Huang | 439/6 |
| 8,075,318 | B2 * | 12/2011 | Zhao et al. | 439/13 |
| 8,157,569 | B1 * | 4/2012 | Liu | 439/11 |
| 8,206,163 | B2 * | 6/2012 | Zhao et al. | 439/131 |
| 2006/0134933 | A1 * | 6/2006 | Huang | 439/22 |

* cited by examiner

*Primary Examiner* — Amy Cohen Johnson
*Assistant Examiner* — Vladimir Imas

(57) ABSTRACT

A rotating plug includes an insulating main body, multiple conductive prongs, multiple conductive connecting terminals, and an insulating rotating member. Electrical wires are disposed in the insulating main body. The conductive prongs are electrically connected with the electrical wires, respectively. Each conductive connecting terminal includes a fixed portion and a swing portion pivotably connected to the fixed portion. The fixed portion is mounted to the insulating main body and electrically connected to a corresponding electrical wire. The swing portion is mounted to the insulating rotating member. The conductive prongs are mounted to the insulating rotating member and electrically connected with the swing portions, respectively. The fixed portions are electrically connected with the electrical wires, respectively. When the swing portions of the conductive connecting terminals rotate, the swing portions may drive the insulating rotating member and conductive prongs to rotate together therewith. The rotating plug is flexible and convenient in use.

10 Claims, 4 Drawing Sheets

ROTATING PLUG

BACKGROUND

1. Field of the Invention

The present invention relates to the field of conductive connection technology and, more particularly, to a rotating plug.

2. Description of Related Art

Most conventional plugs are of a fixed type, i.e. conductive prongs and their insulating housings are fixed together. Plugs can generally be classified into two types, including straight plugs (i.e. electrical wires and prongs are arranged in a straight line) and bent plugs (i.e. electrical wires and prongs are perpendicularly arranged.) However, the plugs of the fixed-type have many constraints and impose high requirement on space of the power outlet and, therefore, are not flexible and convenient in use.

SUMMARY OF THE INVENTION

Accordingly, the present invention is directed to a rotating plug which includes conductive prongs that can be rotated according to need.

A rotating plug includes an insulating main body, a plurality of conductive prongs, a plurality of conductive connecting terminals, and an insulating rotating member. A plurality of electrical wires is disposed in the insulating main body. The conductive prongs are electrically connected with the electrical wires, respectively. Each conductive connecting terminal includes a fixed portion and a swing portion pivotably connected to the fixed portion. The fixed portion is mounted to the insulating main body and electrically connected to a corresponding electrical wire. The swing portion is mounted to the insulating rotating member. The conductive prongs are mounted to the insulating rotating member and electrically connected with the swing portions, respectively. The fixed portions are electrically connected with the electrical wires, respectively.

In one embodiment, one end of the insulating main body has a cutout allowing for pivot connection of the insulating rotating member. The insulating rotating member comprises a pivot portion and a connecting portion connected to the pivot portion. The pivot portion is mounted within the cutout of the insulating main body and is pivotable in the cutout. The conductive prongs are mounted to the connecting portion.

In one embodiment, the conductive prongs are inserted through a base. The connecting portion forms an annular groove. A periphery of the base is positioned in the annular groove and is rotatable with respect to the annular groove. Each conductive prong is electrically connected with a corresponding swing portion through a conductive wire.

In one embodiment, the insulating main body and the insulating rotating member include a plurality of first locking slots and a plurality of second locking slots, respectively. The fixed portions of the conductive connecting terminals are engagingly received in the first locking slots, respectively. The swing portions of the conductive connecting terminals are engagingly received in the second locking slots, respectively.

In one embodiment, the insulating main body has a plurality of first locking slots corresponding to the conductive connecting terminals. The fixed portions are engagingly received in the first locking slots, respectively. Two ends of each fixed portion protrude out of a corresponding first locking slot, with one end electrically connected with a corresponding electrical wire and the other end pivotably connected with a corresponding swing portion.

In one embodiment, each fixed portion comprises a first connecting end and a first pivot end formed by bending the first connecting end. The first connecting end is positioned outside the first locking slot and electrically connected with the electrical wire. The first pivot end is engagingly received in the first locking slot and has an end portion extending out of the first locking slot and pivotably connected with the swing portion.

In one embodiment, each swing portion comprises a second connecting end and a second pivot end formed by bending the second connecting end. The second connecting end is electrically connected with one corresponding conductive prong. The second pivot end is pivotably connected with the first pivot end.

In one embodiment, the insulating rotating member has a plurality of second locking slots corresponding to the conductive connecting terminals. The swing portions are engagingly received in the second locking slots. Two ends of each swing portion extend out of the second locking slot, with one end electrically connected with on corresponding conductive prong and the other end pivotably connected with one corresponding fixed portion.

In one embodiment, each swing portion includes a second connecting end and a second pivot end formed by bending the second connecting end. The second connecting end is engagingly received in the second locking slot and has an end portion extending out of the second locking slot and electrically connected with the conductive prong. The second pivot end is positioned outside the second locking slot and pivotably connected with the fixed portion.

In one embodiment, each fixed portion includes a first connecting end and a first pivot end formed by bending the first connecting end. The first connecting end is electrically connected with one corresponding electrical wire. The first pivot end is pivotably connected with one corresponding swing portion.

In comparison with the conventional plugs, the rotating plug utilizes the conductive connecting terminals to electrically connect the conductive prongs with the electrical wires. The fixed portions and swing portions of the conductive connecting terminals are mounted on the insulating main body and the insulating rotating member, respectively. In addition, the conductive prongs are mounted on the insulating rotating member. As such, when the swing portions of the conductive connecting terminals rotate, the swing portions of the conductive connecting terminals may drive the insulating rotating member to rotate together therewith, which may further drive the conductive prongs to rotate together therewith. The conductive prongs of the rotating plug can rotate, such that uses may rotate the conductive prongs within a certain range to meet actual requirements. As such, it makes it possible to effectively adjust the direction and angle of the plug inserted into a power outlet to adapt to various conditions and environment. In addition, the rotating plug is flexible and convenient in use and space saving.

DETAILED DESCRIPTION

Figure 1:
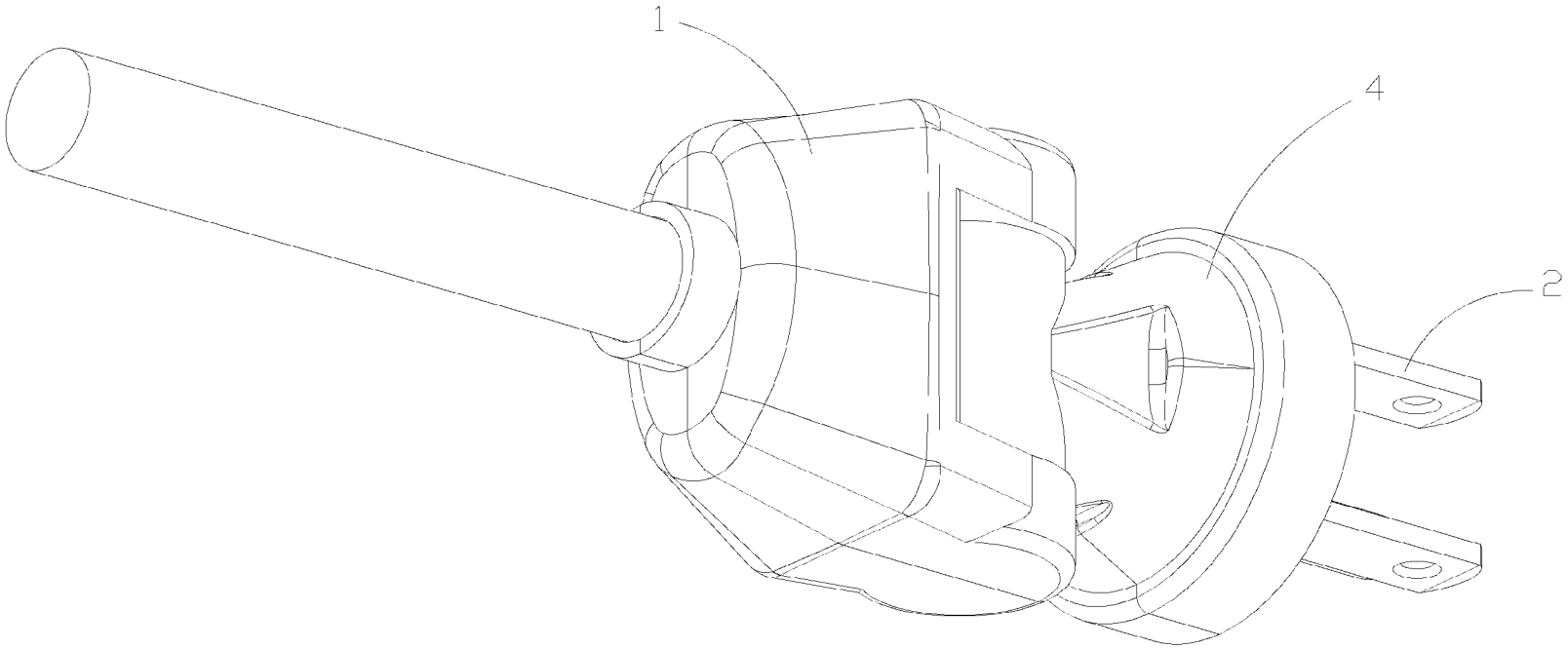
FIG. 1 is a perspective view of one embodiment of a rotating plug.
Figure 2:
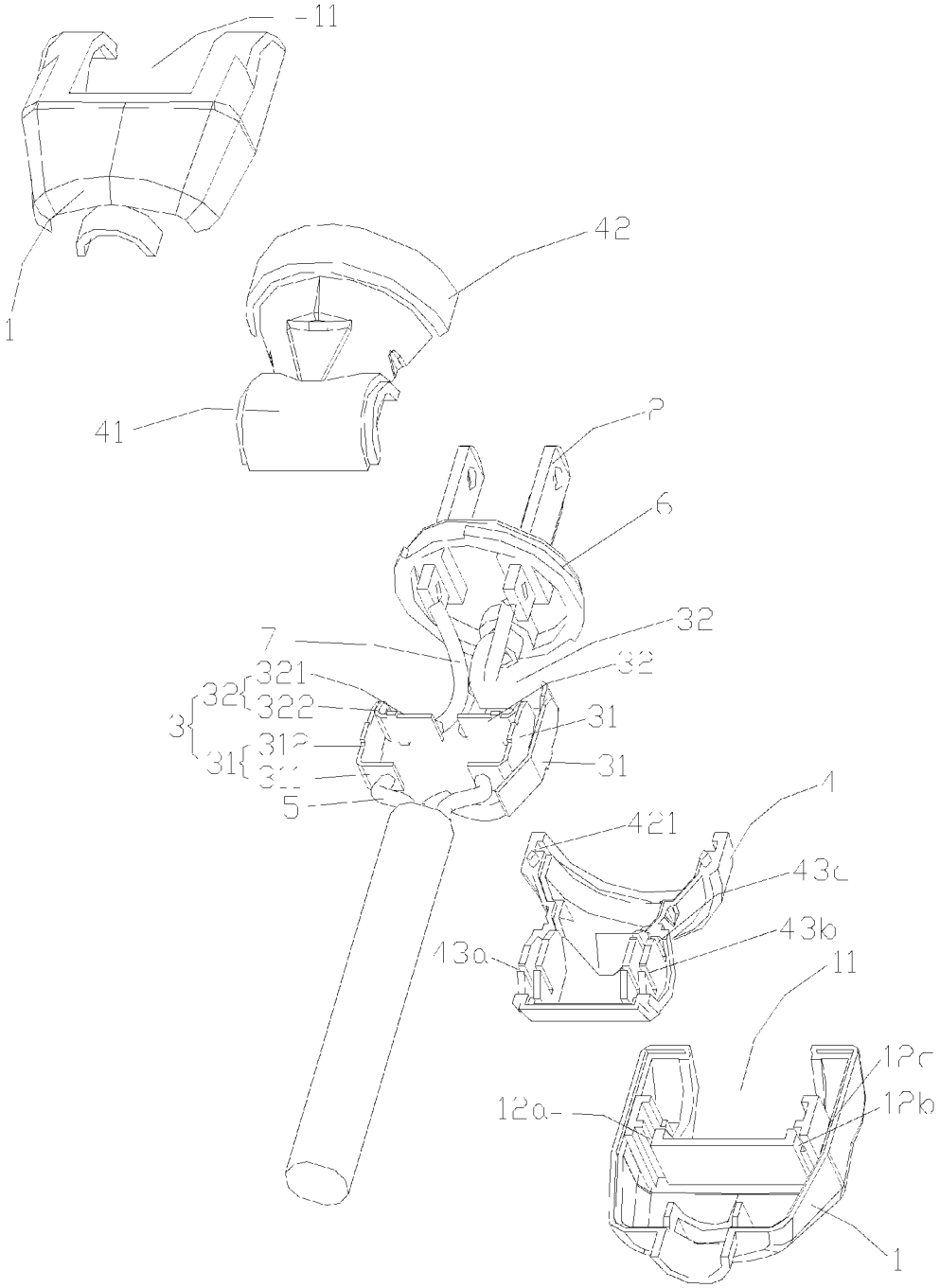
FIG. 2 is an exploded view of the rotating plug of FIG. 1.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIG. 1 to FIG. 4 illustrate one embodiment of a rotating plug. The rotating plug includes an insulating main body 1, a plurality of conductive prongs 2, a plurality of conductive connecting terminals 3, and an insulating rotating member 4. A plurality of electrical wires 5 is disposed in the insulating main body 1. Each conductive prong 2 is electrically connected with a corresponding one of the electrical wires 5. Each conductive connecting terminal 3 includes a fixed portion 31 and a swing portion 32 pivotably mounted to the fixed portion 31. The fixed portions 31 are mounted to the insulating main body 1 and electrically connected with the electrical wires 5, respectively. The swing portions 32 are mounted to the insulating rotating member 4. The conductive prongs 2 are mounted to the insulating rotating member 4 and electrically connected with the swing portion 32, respectively.

Specifically, the insulating main body 1 is formed by two symmetrical housings coupled together. The two housings are fixedly mounted with screws and further bonded together through ultrasound welding, such that the insulating main body 1 has good tightness. One end of the insulating main body 1 has a cutout 11 allowing for pivotal connection of the insulating rotating member 4. A plurality of first locking slots 12 is formed in the insulating main body 1, corresponding to the conductive connecting terminals 3. In the present embodiment, three first locking slots 12*a*, 12*b*, 12*c* are illustrated. One first locking slot 12*a* is positioned in the insulating main body 1 adjacent one side thereof, and the other two first locking slots 12*b*, 12*c* are positioned in parallel with each other in the insulating main body 1 adjacent an opposite side thereof. In the present embodiment, three electrical wires 5 including a live wire, a neutral wire and an earth wire are disposed in the insulating main body 1.

The conductive prongs 2 are made of copper sheets which have good conductivity and stability. In the present embodiment, there are three conductive prongs 2 electrically connected with the live, neutral and earth wires, respectively. Each conductive prong 2 is inserted through an insulating base 6.

The insulating rotating member 4 is also formed by two symmetrical housings coupled together. The two housings are also fixedly mounted with screws and further bonded together through ultrasound welding, such that the insulating rotating member 4 also has good tightness. The insulating rotating member 4 includes a pivot portion 41 and a connecting portion 42 connected with the pivot portion 41. The pivot portion 41 is mounted within the cutout 11 of the insulating main body 1 and pivotable within the cutout 11. The conductive prongs 2 are mounted to the connecting portion 42. An annular groove 421 is formed in the connecting portion 42. A periphery of the base 6 is positioned in the annular groove 421 and rotatable with respect to the annular groove 421. Each conductive prong 2 is electrically connected to one corresponding swing portion 32 through an electrical wire 7. Due to the flexibility of the electrical wire 7, the conductive prong 2 can rotate with the base 6 within a certain range about an axis of the base 6.

A plurality of second locking slots 43 is formed in the insulating rotating member 4. In the present embodiment, there are three second locking slots 43*a*, 43*b*, 43*c*, which are all formed in the pivot portion 41. One second locking slot 43*a* is positioned in the pivot portion 41 adjacent one side thereof, and the other two locking slots 43*b*, 43*c* are positioned in parallel with each other in the pivot portion 41 adjacent an opposite side thereof.

The conductive connecting terminals 3 are also made of copper sheets, which also have good conductivity and stability. The fixed portions 31 of the conductive connecting terminals 3 are engagingly received in the respective first locking slots 12. Two ends of each fixed portion 31 protrude out of the corresponding first locking slot 12, with one end electrically connected with one corresponding electrical wire 5 and the other end pivotably connected with a corresponding swing portion 32. The swing portions 32 of the conducive connecting terminals 3 are engagingly received in the corresponding second locking slots 42. Two ends of each swing portion 32 protrude out of the corresponding second locking slot 42, with one end electrically connected with one corresponding conductive prong 2 and the other end pivotably connected with one corresponding fixed portion 31.

Specifically, each fixed portion 31 includes a first connecting end 311 and a first pivot end 312 formed by bending the first connecting end 311. The first connecting end 311 is positioned outside the first locking slot 12 and electrically connected with the electrical wire 5. The first pivot end 312 is engagingly received in the first locking slot 12 and has an end portion extending out of the first locking slot 12 and pivotably connected with the swing portion 32. Each swing portion 32 includes a second connecting end 321 and a second pivot end 322 formed by bending the second connecting end 321. The second connecting end 321 is engagingly received in the second locking slot 42 and has an end portion extending out of the second locking slot 42 and electrically connected with the conductive prong 2. The second pivot end 322 is positioned outside the second locking slot 42 and pivotably connected with the first pivot end 312.

Figure 3:
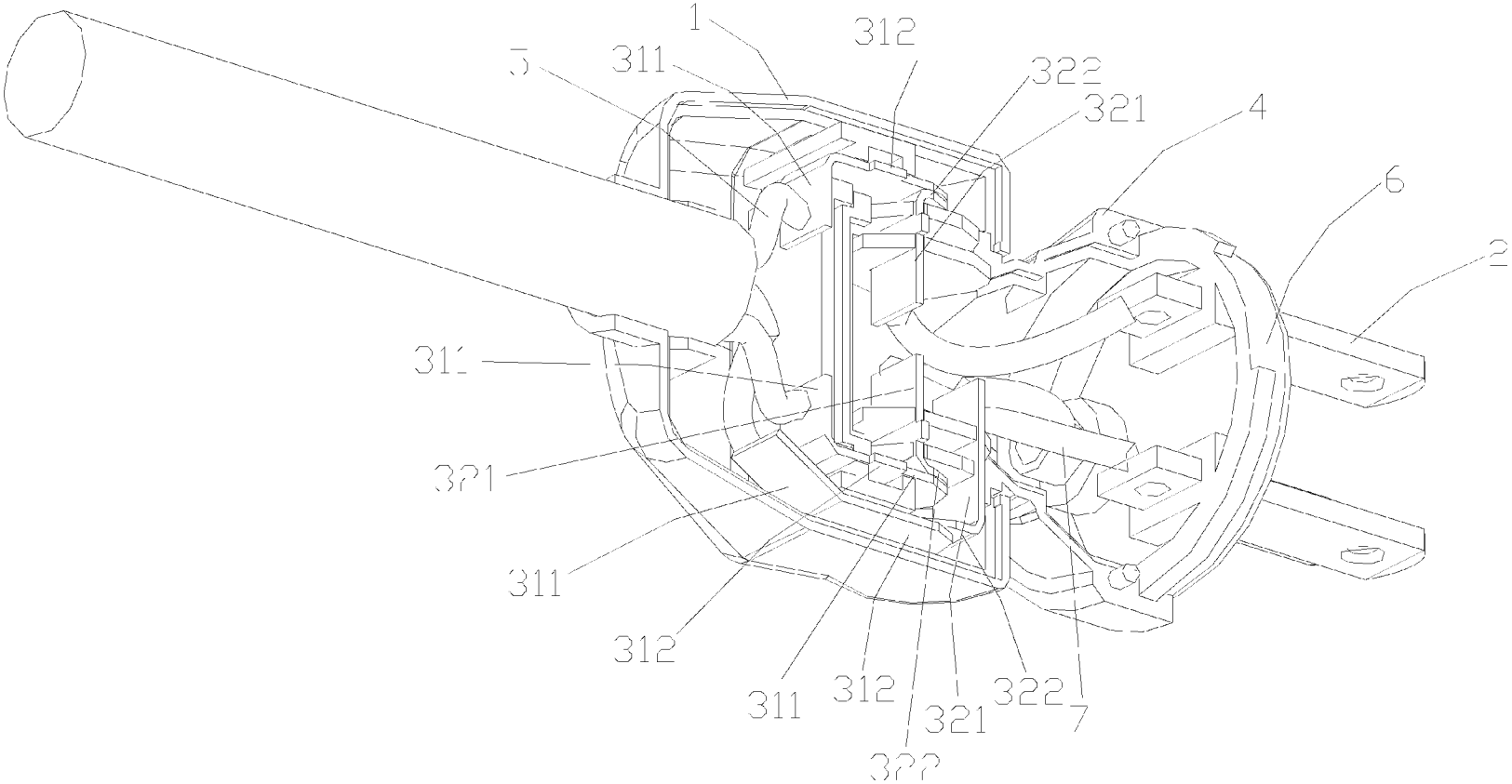
FIG. 3 is a partially assembled view of the rotating plug of FIG. 1 in one state.
Figure 4:
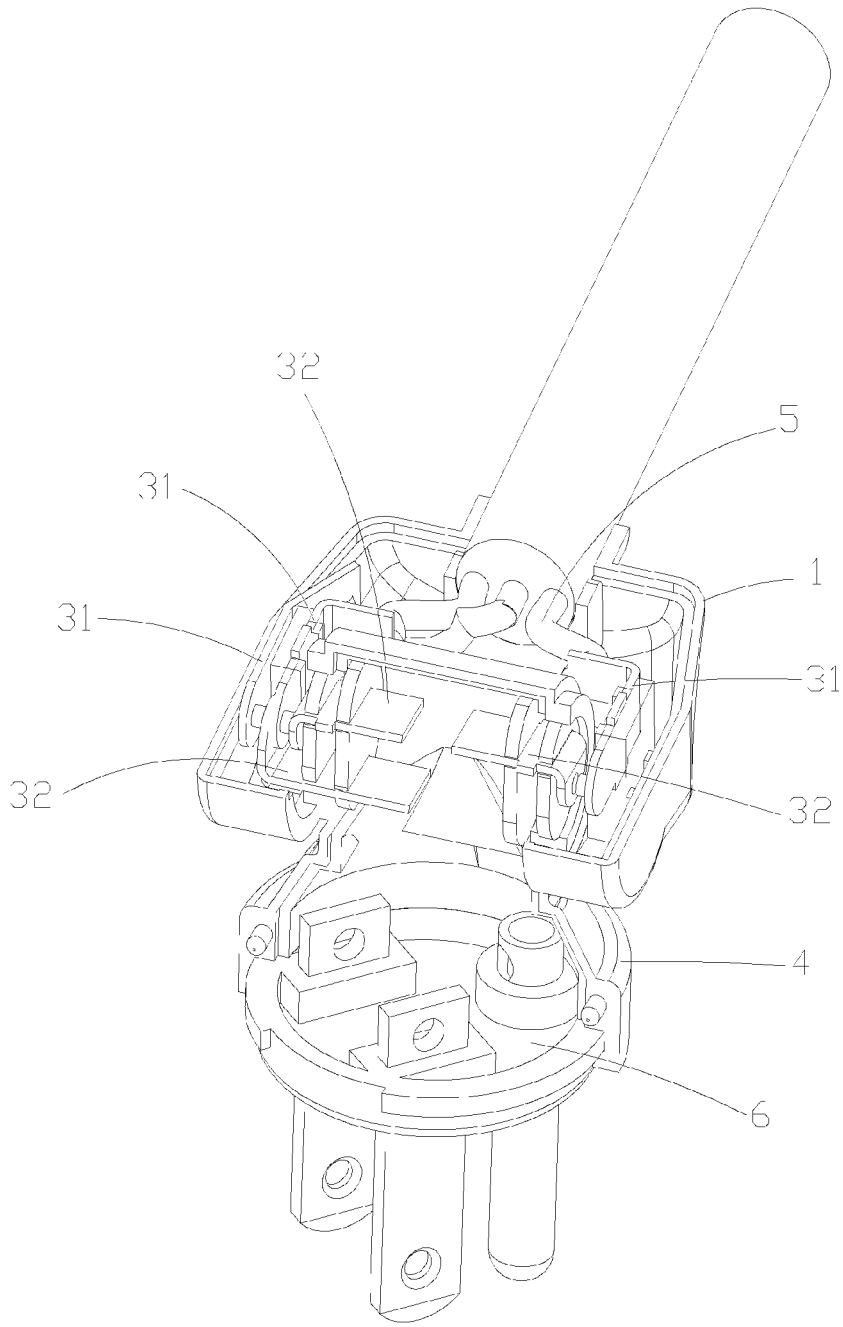
FIG. 4 is a partially assembled view of the rotating plug of FIG. 1 in another state.

In the rotating plug described above, the conductive connecting terminals 3 electrically connect the conductive prongs 2 with the electrical wires 5. The fixed portions 31 and swing portions 32 of the conductive connecting terminals 3 are mounted on the insulating main body 1 and the insulating rotating member 4, respectively. In addition, the conductive prongs 2 are mounted on the insulating rotating member 4. As such, when the swing portions 32 of the conductive connecting terminals 3 rotate, the swing portions 32 of the conductive connecting terminals 3 may drive the insulating rotating member 4 rotate together therewith, which may further drive the conductive prongs 2 to rotate together therewith. FIG. 3 illustrates a state where the conductive prongs 2 and the electrical wires 5 are arranged in a straight line. FIG. 4 illustrates a state where the conductive prongs 2 are rotated 90 degrees to be perpendicular with the electrical wires 5.

The conductive prongs 2 of the rotating plug have a rotating function, such that users may rotate the conductive prongs 2 within a certain range to meet actual requirements (in the present embodiment, the conductive prongs 2 may be rotated 90 degrees clockwise or counter-clockwise and, therefore, it has a total rotating range of 180 degrees). As such, it makes it possible to effectively adjust the direction and angle of the plug inserted into a power outlet to adapt to various conditions and environment. In addition, the rotating plug is flexible and convenient in use and space saving.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A rotating plug comprising an insulating main body and a plurality of conductive prongs, a plurality of electrical wires disposed in the insulating main body, the conductive prongs electrically connected with the electrical wires, respectively, wherein the rotating plug further comprises a plurality of conductive connecting terminals and an insulating rotating member; each conductive connecting terminal comprises a fixed portion and a swing portion pivotably connected to the fixed portion, the fixed portion is mounted to the insulating main body and electrically connected to one corresponding electrical wire, the swing portion is mounted to the insulating rotating member, the conductive prongs are mounted to the insulating rotating member and electrically connected with the swing portions, respectively; the fixed portions are electrically connected with the electrical wires, respectively.

2. The rotating plug according to claim 1, wherein one end of the insulating main body has a cutout allowing for pivot connection of the insulating rotating member, the insulating rotating member comprises a pivot portion and a connecting portion connected to the pivot portion, the pivot portion is mounted within the cutout of the insulating main body and is pivotable in the cutout, the conductive prongs are mounted to the connecting portion.

3. The rotating plug according to claim 2, wherein the conductive prongs are inserted through a base, the connecting portion forms an annular groove, a periphery of the base is positioned in the annular groove and is rotatable with respect to the annular groove, each conductive prong is electrically connected with one corresponding swing portion through a conductive wire.

4. The rotating plug according to claim 1, wherein the insulating main body and the insulating rotating member include a plurality of first locking slots and a plurality of second locking slots, respectively, the fixed portions of the conductive connecting terminals are engagingly received in the first locking slots, respectively, and the swing portions of the conductive connecting terminals are engagingly received in the second locking slots, respectively.

5. The rotating plug according to claim 1, wherein the insulating main body includes a plurality of first locking slots corresponding to the conductive connecting terminals, the fixed portions are engagingly received in the first locking slots, respectively, and two ends of each fixed portion protrude out of a corresponding first locking slot, with one end electrically connected with one corresponding electrical wire and the other end pivotably connected with one corresponding swing portion.

6. The rotating plug according to claim 5, wherein each fixed portion comprises a first connecting end and a first pivot end formed by bending the first connecting end, the first connecting end is positioned outside the first locking slot and electrically connected with the electrical wire, the first pivot end is engagingly received in the first locking slot and has an end portion extending out of the first locking slot and pivotably connected with the swing portion.

7. The rotating plug according to claim 6, wherein each swing portion comprises a second connecting end and a second pivot end formed by bending the second connecting end, the second connecting end is electrically connected with one corresponding conductive prong, and the second pivot end is pivotably connected with the first pivot end.

8. The rotating plug according to claim 1, wherein the insulating rotating member includes a plurality of second locking slots corresponding to the conductive connecting terminals, the swing portions are engagingly received in the second locking slots, two ends of each swing portion extend out of the second locking slot, with one end electrically connected with one corresponding conductive prong and the other end pivotably connected with one corresponding fixed portion.

9. The rotating plug according to claim 8, wherein each swing portion includes a second connecting end and a second pivot end formed by bending the second connecting end, the second connecting end is engagingly received in the second locking slot and has an end portion extending out of the second locking slot and electrically connected with the conductive prong, the second pivot end is positioned outside the second locking slot and pivotably connected with the fixed portion.

10. The rotating plug according to claim 9, wherein each fixed portion includes a first connecting end and a first pivot end formed by bending the first connecting end, the first connecting end is electrically connected with one corresponding electrical wire, and the first pivot end is pivotably connected with one corresponding swing portion.

* * * * *